US007507301B2

(12) United States Patent
Wilson

(10) Patent No.: US 7,507,301 B2
(45) Date of Patent: Mar. 24, 2009

(54) CLEANING COMPOSITIONS AND METHODS OF TREATING EQUIPMENT

(75) Inventor: Paul A. Wilson, Cartersville, GA (US)

(73) Assignee: Victoria E. Wilson and Matthew P. Wilson Trust, Cartersville, GA (US)

( * ) Notice: Subject to any disclaimer, the term of this patent is extended or adjusted under 35 U.S.C. 154(b) by 347 days.

(21) Appl. No.: 11/123,787

(22) Filed: May 6, 2005

(65) Prior Publication Data

US 2005/0202989 A1 Sep. 15, 2005

Related U.S. Application Data

(63) Continuation-in-part of application No. 10/159,637, filed on May 30, 2002, now Pat. No. 7,223,723.

(51) Int. Cl.
*C11D 17/00* (2006.01)

(52) U.S. Cl. ..... 134/38; 510/245; 510/365; 510/407

(58) Field of Classification Search ..... 510/245, 510/365, 407; 134/38
See application file for complete search history.

(56) References Cited

U.S. PATENT DOCUMENTS

| | | | | |
|---|---|---|---|---|
| 3,951,827 | A * | 4/1976 | Burroughs et al. | 507/241 |
| 3,956,197 | A | 5/1976 | Schoenholz et al. | 252/526 |
| 3,968,046 | A | 7/1976 | Smeets | 252/95 |
| 4,096,869 | A * | 6/1978 | Lawson | 134/3 |
| 4,102,823 | A | 7/1978 | Matheson et al. | 252/533 |
| 4,108,681 | A | 8/1978 | Lawson et al. | 134/20 |
| 4,552,681 | A | 11/1985 | Koch et al. | 510/356 |
| 5,474,698 | A | 12/1995 | Rolando et al. | 510/445 |
| 5,514,295 | A | 5/1996 | Flower | 252/174 |
| 5,762,821 | A * | 6/1998 | Tate | 252/180 |
| 5,789,361 | A | 8/1998 | Talley | 510/218 |
| 5,972,868 | A * | 10/1999 | Athey et al. | 510/247 |
| 6,071,434 | A * | 6/2000 | Davis et al. | 252/389.2 |
| 6,156,716 | A * | 12/2000 | Ahmed | 510/272 |
| 6,180,592 | B1 * | 1/2001 | Smith et al. | 510/505 |
| 6,239,097 | B1 * | 5/2001 | Wilson | 510/405 |

FOREIGN PATENT DOCUMENTS

| | | | |
|---|---|---|---|
| SU | 1433961 | A | 10/1988 |
| SU | 1682374 | A | 10/1991 |

* cited by examiner

*Primary Examiner*—Gregory E Webb
(74) *Attorney, Agent, or Firm*—Thomas, Kayden, Horstemeyer & Risley, LLP

(57) ABSTRACT

Cleaning compositions and methods of use thereof are described. A representative method includes treating equipment, particularly equipment used in the asphalt industry and other industries, such as bituminous, rubber, plastics, polymer, tar, concrete, and cement industries. The methods employ a cleaning composition that includes at least one or more of the following: surfactants, builders, hydrotropes, alkali compounds, processing aids, organic acids, and water conditioners, in any combination.

22 Claims, No Drawings

CLEANING COMPOSITIONS AND METHODS OF TREATING EQUIPMENT

RELATED APPLICATIONS

This application is a continuation-in-part and claims priority to U.S. Ser. No. 10/159,637, filed May 30, 2002 now U.S. Pat. No. 7,223,723, entitled "Cleaning Compositions," which is entirely incorporated herein by reference.

TECHNICAL FIELD

This disclosure relates to cleaning compositions and methods of use thereof.

BACKGROUND

The vast majority of industrial cleaning problems are solved with existing technology since these problems have existed for many years and the types of material to be cleaned are typical across different industries. Many industrial cleaners are based on solvent technology where the solvent itself provides the cleaning ability of the product. These cleaners may be "pure" solvents like mineral spirits, Stoddard solvent, 1,1,1-trichloroethane, or others known to those who are skilled in the art. Other cleaners include additives such as emulsifiers or surface-active agents. In addition, other cleaners are water-based and contain varying percentages of solvents dissolved in water or emulsified. Solvent and solvent-based cleaners are regulated by Environmental Protection Agency (EPA), both as volatile organic compounds and as potential water and ground pollutants.

One industry that encounters unique cleaning problems is the hot mix asphalt (HMA) industry. HMA is a mixture of liquid asphalt and aggregate with special additives used to modify the final product to yield a particular set of properties to the finished material and to assist in the mixing and handling properties during manufacturing, transportation, and laying of the surface. HMA as the name implies, is hot, with typical temperatures up to and exceeding 340° F., causing problems with cleaning operations. The liquid asphalt is liquid at the elevated temperatures where it is processed into HMA, but becomes sticky and eventually solid as the temperature falls. During the manufacturing and handling processes, HMA adheres to nearly every surface it contacts. Thus, during the process of paving roads, runways, parking areas, etc., HMA adheres to the equipment involved in manufacturing the asphalt, in transporting the asphalt to the paving site, and in disposing the asphalt on the particular site.

Therefore, the HMA industry is unique because of the nature of the materials encountered and the conditions under which the material is produced, transported, and applied, as well as environmental problems encountered during cleaning and reclaiming the cleaner. Similar problems exist in similar industries such as the bitumen industry, the tire-manufacturing industry, the rubber manufacturing industry, and other allied industries.

The largest group of industrial cleaners is based on detergents. The products in this group are water based and contain a surfactant (or a combination of surfactants), and other components. However, these cleaners have proven to be ineffective in removing asphalt or related materials during the cleaning process.

Traditionally, diesel fuel is used as a cleaning agent. However, environmental considerations have resulted in the EPA, the Federal Highway Administration, and many state transportation departments to ban its use. Most other solvent-based cleaners are not effective, present fire and explosion hazards at the elevated temperatures, or are not environmentally acceptable. Emulsions or emulsion forming products containing various hydrocarbons, vegetable based oils and esters (e.g., soy and terpene compounds), or other solvents have been used, but they, like diesel fuel, have a negative environmental impact and/or have potential negative human health effects. Other cleaners have, in the past, indicated that they can remove adhered asphalt from surfaces; however, many of these cleaners are expensive and remove less than 45% of the adhered asphalt.

Thus, there is a need in the industry for a cleaning agent that overcomes at least these disadvantages.

SUMMARY

Briefly described, the present disclosure provides for cleaning compositions and methods of use thereof. A representative method includes applying a cleaning composition to the equipment. A representative cleaning composition includes at least one or more of the following: 0.2% to about 25% of a surfactant, about 5% to about 99% of a builder, about 5% to about 95% of a hydrotrope, about 0.1% to about 35% of an alkali compound, about 2% to about 85% of a processing aids, an organic acids, and about 2% to about 60% of a water conditioner, in any combination.

Other compositions, methods, features, and advantages of the present disclosure will be or become apparent to one with skill in the art upon examination of the following detailed description. It is intended that all such additional compositions, methods, features, and advantages be included within this description, be within the scope of the present disclosure, and be protected by the accompanying claims.

DETAILED DESCRIPTION

The present disclosure provides for cleaning compositions and methods of use thereof that overcome at least some of the problems associated with cleaning equipment used to, handle, manufacture, transfer, and dispose of materials (e.g., bituminous materials, tar materials, rubber materials, and/or polymer materials). In addition, embodiments of the cleaning composition are generally environmentally acceptable.

Embodiments of the cleaning composition can be used to treat equipment in a broad range of industrial fields. These industries include, for example, the bituminous industry, rubber industry, plastics industry, polymer industry, tar industry, and concrete and cement industry. In particular, these industries include the tire-manufacturing industry, oil industry, floor tile manufacturing industry, cold patch asphalt industry, rubber parts manufacturing industry, roofing industry, mining industry (e.g., mud, kaolin, barite, clay(s), salt, coal, iron ore, etc.), and oil industry. Also, the cleaning compositions can be used to treat equipment that is used in mix designs such as polymer modified asphalt (PMA) mix designs, crumb rubber mix designs, stone matrix asphalt (SMA) mix designs, superpave mix designs, open grade friction course (OGFC) mix designs, and slag containing asphalt mix designs.

The equipment can include, for example, transportation vehicle beds, waste chutes and belts, tools (e.g., shovel, saws, and rakes), shuttle buggy and various other material transport devices, paving machines, drag chains, drums, batchers, flop gates, silos, drag conveyors, bucket elevators, and transfer belts. In the concrete and cement industry, the disclosed cleaning compositions can be used to clean equipment employed in the production of masonry, poured walls, precast prestressed walls and foundations, pipes, blocks, and roadways. Additionally, the cleaning compositions can be used to clean all equipment associated with concrete and cement, including for example, trucks, spreaders, forms, pumping equipment, etc., and all equipment used, starting with the production of the cement in the kiln to the finished concrete/cement product. In addition, the disclosed compositions can be used to prevent concrete and/or cement from hardening, i.e., "setting up." In one exemplary method, an embodiment of the disclosed compositions is added to concrete and/or cement, thereby substantially reducing the ability of the concrete or cement to harden.

The materials that come into contact with the equipment discussed above include, for example, bituminous materials, tar materials, rubber materials, polymer materials, or combinations thereof. Bituminous materials include, for example, asphalt, pitch, and bituminous-modified materials. Tar materials include, for example, tar, rosins, and tar-modified materials. Rubber materials include, for example, natural rubber materials, synthetic rubber materials, natural latex, synthetic latex, and rubber-modified materials. Polymer materials include, for example, latex, natural polymers, synthetic polymers, and polymer-modified materials, and carpets. As indicated for each of the materials above, the cleaning composition can be used to treat modified materials, such as a polymer-modified bituminous material, a rubber-modified polymer, and various blends or mix designs thereof.

Embodiments of the cleaning composition can be used as a cleaning agent, release agent, and/or a preventative agent (i.e., an agent applied to prevent material from adhering to the equipment to maintain cleanliness) to treat equipment. For example, the cleaning composition can be applied (e.g., sprayed or soaked) to equipment having material disposed thereon, in which case the cleaning composition acts as a cleaning agent/release agent that can substantially displace the adhered material. In addition, the cleaning composition acts as a preventative agent after the adhered material is removed. Therefore, the cleaning composition can act as a cleaning/release agent and a cleaning/release/preventative agent.

Alternatively, the cleaning composition can be applied onto equipment that is clean (i.e., equipment having little or no material adhered to it). For example, the cleaning composition acts as a preventative agent when applied to clean equipment because the material does not substantially adhere to the equipment after the cleaning composition has been applied.

Methods of treating equipment are also included in the present disclosure. One embodiment of a method of treating equipment includes the step of applying a basic, aqueous cleaning composition to equipment, the equipment including that from at least one of the following industries: asphalt, concrete, cement, mining, bituminous, and oil held, and wherein the cleaning composition comprises: about 0.1% to about 99% by weight of an alkali, wherein the alkali is chosen from at least one of the following: sodium hydroxide, potassium hydroxide, calcium hydroxide, magnesium hydroxide, cesium hydroxide, monoethylamine, diethylamine, triethylamine, monomethylamine, dimethylamine, trimethylamine, isopropylamine, diisopropylamine, isoprapanolamine, diisoprapanolamine, triisopropanolamine, monoethanol amine, diethanolamine, triethanolamine, ammonium hydroxide, sodium aluminate, potassium aluminate, calcium oxide, magnesium oxide, cesium oxide, sodium metasilicate, monosodium phosphate, disodium phosphate, trisodium phosphate, sodium tripolyphosphate, sodium sulfate, sodium borate, sodium carbonate, sodium hydrogen carbonate, sodium sesquicarbonate, sodium orthosilicate, sodium sesquisilicate, sodium polysilicates, alkaline sodium silicate, neutral sodium silicate, and combinations thereof; and about 0.1% to about 30% by weight of a surfactant, wherein the surfactant is chosen from at least one of the following: anionic detergent, cationic detergent, phosphate ester detergent, non-ionic detergent, ether sulfate detergent, amphoteric detergent, sodium soap of a fatty acid, sodium soap of a fatty acid ester, potassium soap of a fatty acid, potassium soap of a fatty acid ester, lard, tall oil, coconut fatty acid, stearic acid, oleic acid, palmitic acid, and combinations thereof.

One embodiment of a method of treating equipment includes the step of applying an aqueous cleaning composition to equipment, wherein the equipment includes that from at least one of the following industries: asphalt, concrete, cement, mining, bituminous, and oil field, and wherein the cleaning composition consists essentially of a processing aid chosen from at least one of the following: carboxymethylcellulose, sodium alginate, monosaccharide, oligosaccharide, polysaccharide, disaccharide, trisaccharide, tetrasaccharide, pentasaccharide, hexassaccharide, heptasaccharide, octasaccharide, nonasaccharide, sugar alcohol, 1,6-dichloro-l, 6-dideoxy-BETA-D-fructofuranosyl-4-chloro-4-deoxy-alpha-D-galactopyranoside, sorbitol, manitol, erythritol, xylitol, lactitol, esters of saccarides, sorbate, lactate, amino-saccharide, gum, guar gum, xanthan, polyacrylate, polymethacrylate, polyethylacrylate, polypropylacrylate, polybutylacrylate, polyethylacrylate, polyhexylacrylate, polyheptylacrylate, polyoctylacrylate, polynonyl acrylate, polydecyl acrylate, polyundecyl acrylate, polydodecyl acrylate, vinylacrylates, polyvinylacrylates, vinyl acetates, polyvinylacetates, polyacrylamides, polylactates, polyglycolates, polyacetates, formates, acetates, glycolates, lactates, gluconates, glucarates, glucoheptonates, mixed polyacrylate-polymalate, polyacrylic acid partial sodium salt, and combinations thereof.

One embodiment of a method of treating equipment includes the step of applying an aqueous cleaning composition to equipment, wherein the equipment includes that from at least one of the following industries: asphalt, concrete, cement, mining, bituminous, and oil field, and wherein the cleaning composition comprises: about 0.2% to about 85% by weight of a processing aid, the processing aid being chosen from at least one of the following: carboxymethylcellulose sodium alginate, monosaccharide, oligosaccharide, polysaccharide, disaccharide, trisaccharide, tetrasaccharide, pentasaccharide, hexassaccharide, heptasaccharide, octasaccharide, nonasaccharide, sugar alcohol, 1,6-dichloro- 1,6-dideoxy-BETA-D-fructofuranosyl-4-chloro-4-deoxy-alpha-D-galactopyranoside, sorbitol, manitol, erythritol, xylitol, lactitol, esters of saccharides, sorbate, lactate, amino-saccharide, gum, guar gum, xanthan, polyacrylate, polymethacrylate, polyethylacrylate, polypropylacrylate, polybutylacrylate, polypentylacrylate, polyhexylacrylate, polyheptylacrylate, polyoctylacrylate, polynonyl acrylate, polydecyl acrylate, polyundecyl acrylate, polydodecyl acrylate, vinylacrylates, polyvinylacrylates, vinyl acetates, polyvinylacetates, polyacrylamides, polylactates, polyglycolates, polyacetates, formates, acetates, glycolates, lactates, gluconates, glucarates, glucoheptonates, mixed polyacrylate-polymalate, polyacrylic acid partial sodium salt, and combinations thereof; and about 0.1% to about 99% by weight of an alkali, wherein the alkali is chosen from at least one of the following: sodium hydroxide, potassium hydroxide, calcium hydroxide, magnesium hydroxide, cesium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, potassium aluminate, calcium oxide, magnesium oxide, cesium oxide, sodium tripolyphosphate, sodium sulfate, sodium borate, sodium carbonate, sodium hydrogen carbonate, sodium sesquicarbonate, sodium orthosilicate, sodium sesquisilicate, sodium polysilicates, alkaline sodium silicate, neutral sodium silicate and combinations thereof.

One embodiment of a method of treating equipment includes the step of applying an aqueous cleaning composition to equipment, wherein the equipment includes that from at least one of the following industries: asphalt, concrete, cement, mining, bituminous, and oil field, and wherein the cleaning composition comprises: about 0.2% to about 60% of an organic acid, the organic acid being chosen from at least one of the following: mono-chloro acetic acid (MCAA), carbonic acid, formic acid, acetic acid, acrylic acid, glycolic acid, lactic acid, propionic acid, maleic acid, malic acid, gluconic acid, glucaric acid, mucic acid, heptanoic acid, hexanoic acid, and combinations thereof, and about 0.1% to about 95% by weight of a water conditioner, the water conditioner being chosen from at least one of the following: ethylenediaminetetraacetic acid and salts thereof, nitrilotriacetic acid and salts thereof, sodium citrate, sodium gluconate, sodium glucoheptonate, polymaleic acid, polyacrylate, and combinations thereof One embodiment of a method of treating equipment includes the step of applying a basic, aqueous cleaning composition to equipment, wherein the equipment includes that from at least one of the following industries: asphalt, concrete, cement, mining, bituminous, and oil field, and wherein the cleaning composition consists essentially of: a builder chosen from at least one of the following: sodium metasilicate, monosodium phosphate, disodium phosphate, trisodium phosphate, sodium tripolyphosphate, sodium sulfate, sodium borate, sodium carbonate, sodium hydrogen carbonate, sodium sesquicarbonate, sodium orthosilicate, sodium sesquisilicate, sodium polysilicates, alkaline sodium silicate, neutral sodium silicate, sodium hydroxide, potassium hydroxide, calcium hydroxide, magnesium hydroxide, cesium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, potassium aluminate, calcium oxide, magnesium oxide, cesium oxide, and combinations thereof.

One embodiment of method of treating equipment is disclosed, wherein the equipment includes that from at least one of the following industries: asphalt, concrete, cement, mining, bituminous, and oil field, the method including the step of applying a basic, aqueous cleaning composition to equipment, and wherein the cleaning composition comprises: about 0.1% to about 99% by weight builder, the builder being chosen from at least one of the following: sodium metasilicate monosodium phosphate, disodium phosphate, trisodium phosphate, sodium tripolyphosphate, sodium sulfate, sodium borate, sodium carbonate, sodium hydrogen carbonate, sodium sesquicarbonate, sodium orthosilicate, sodium sesquisilicate, sodium polysilicates, alkaline sodium silicate, neutral sodium silicate, sodium hydroxide, potassium hydroxide, calcium hydroxide, magnesium hydroxide, cesium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, potassium aluminate, calcium oxide, magnesium oxide, cesium oxide, and combinations thereof, and about 0.1% to about 30% by weight of a surfactant, wherein the surfactant is chosen from at least one of the following: anionic detergent, cationic detergent, phosphate ester detergent, non-ionic detergent, ether sulfate detergent, amphoteric detergent, sodium soap of a fiat acid, sodium soap of a fatty acid ester, potassium soap of a fatty acid, potassium soap of a fatty acid ester, lard, tall oil, coconut fatty acid, stearic acid, oleic acid, palmitic acid, and combinations thereof.

One embodiment of a disclosed method of treating equipment is disclosed, wherein the equipment includes that from at least one of the following industries: asphalt, concrete, cement, mining, bituminous, and oil field, and the method including the step of applying a aqueous cleaning composition to equipment, wherein the equipment includes asphalt industry equipment, mining industry equipment, bituminous industry equipment, tire manufacture industry equipment, rubber parts manufacturing industry equipment and oil field industry equipment, and wherein the cleaning composition comprising: a processing aid, the processing aid being chosen from at least one of the following: carboxymethylcellulose sodium alginate, monosaccharide, oligosaccharide, polysaccharide, disaccharide, trisaccharide, tetrasaccharide, pentasaccharide, hexassaccharide. heptasaccharide, octasaccharide, nonasaccharide, sugar alcohol, 1,6-dichloro-1,6-dideoxy-BETA-D-fructofuranosyl-4 -chloro-4-deoxy-alpha-D-galactopyranoside, sorbitol, manitol, erythritol, xylitol, lactitol, esters of saccharides, sorbate, lactate, aminosaccharide, gum, guar gum, xanthan, polyacrylate, polymethacrylate, polyethylacrylate, polypropylacrylate, polybutylacrylate, polypentylacrylate, polyhexylacrylate, polyheptylacrylate, polyoctylacrylate, polynonyl acrylate, polydecyl acrylate, polyundecyl acrylate, polydodecyl acrylate, vinylacrylates, polyvinylacrylates, vinyl acetates, polyvinylacetates, polyacrylamides, polylactates, polyglycolates, polyacetates, formates, acetates, glycolates, lactates, gluconates, glucarates, glucoheptonates, mixed polyacrylate-polymalate, polyacrylic acid partial sodium salt, and combinations thereof; the cleaning composition further including at least one of the following: an alkali, wherein the alkali is chosen from at least one of the following: sodium hydroxide, potassium hydroxide, calcium hydroxide, magnesium hydroxide, cesium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, potassium aluminate, calcium oxide, magnesium oxide, cesium oxide, sodium metasilicate, monosodium phosphate, disodium phosphate, trisodium phosphate, sodium tripolyphosphate, sodium sulfate, sodium borate, sodium carbonate, sodium hydrogen carbonate, sodium sesquicarbonate, sodium orthosilicate, sodium sesquisilicate, sodium polysilicates, alkaline sodium silicate, neutral sodium silicate, and combinations thereof; a surfactant, wherein the surfactant is chosen from at least one of the following: anionic detergent, cationic detergent, phosphate ester detergent, non-ionic detergent, ether sulfate detergent, amphoteric detergent, sodium soap of a fatty acid, sodium soap of a fatty acid ester, potassium soap of a fatty acid, potassium soap of a fatty acid ester, lard, tall oil, coconut fatty acid, stearic acid, oleic acid, palmitic acid, and combinations thereof; a hydrotrope, the hydrotrope being chosen from at least one of the following: sodium xylene sulfonate, sodium toluenesulfonate, surfactant-hydrotropes, urea, and combinations thereof; a water conditioner, the water conditioner being chosen from at least one of the following: ethylenediaminetetraacetic acid and salts thereof, nitrilotriacetic acid and salts thereof, sodium citrate, sodium gluconate, sodium glucoheptonate, polymaleic acid, polyacrylate, and combinations thereof; and an organic acid, the organic acid being chosen from at least one of the following: mono-chloro acetic acid (MCAA), carbonic acid, formic acid, acetic acid, acrylic acid, glycolic acid, lactic acid, propionic acid, maleic acid, malic acid, gluconic acid, glucaric acid, mucic acid, heptanoic acid, hexanoic acid, and combinations thereof. One embodiment of a disclosed method of treating equipment includes the step of applying a basic, aqueous cleaning composition to equipment, the equipment including concrete and cement industry equipment and the cleaning composition consisting essentially of: a processing aid, the processing aid being chosen from at least one of the following: carboxymethylcellulose sodium alginate, monosaccharide, oligosaccharide, polysaccharide, disaccharide, trisaccharide, tetrasaccharide, pentasaccharide, hexassaccharide, heptasaccharide, octasaccharide, nonasaccharide, sugar alcohol, 1,6-dichloro- 1,6-dideoxy-BETA-D-fructofuranosyl-4-chloro4deoxy-alpha-D-galactopyranoside, sorbitol, manitol, erythritol, xylitol, lactitol, esters of saccharides, sorbate, lactate, amino-saccharide, gum, guar gum, xanthan, polyacrylate, polymethacrylate, polyethylacrylate, polypropylacrylate, polybutylacrylate, polypentylacrylate, polyhexylacrylate, polyheptylacrylate, polyoctylacrylate, polynonyl acrylate, polydecyl acrylate, polyundecyl acrylate, polydodecyl acrylate, vinylacrylates, polyvinylacrylates, vinyl acetates. polyvinylacetates, polyacrylamides, polylactates, polyglycolates, polyacetates, formates, acetates, glycolates, lactates, gluconates, glucarates, glucoheptonates, mixed polyacrylate-polymalate, polyacrylic acid partial sodium salt, and combinations thereof: and the cleaning composition farther consisting essentially of one of the following: an alkali, wherein the alkali is chosen from at least one of the following: sodium hydroxide, potassium hydroxide, calcium hydroxide, magnesium hydroxide, cesium hydroxide, monoethylamine, diethylamine, triethylamine, monomethylamine, dimethylamine, trimethylamine, isopropylamine, diisopropylamine, isoprapanolamine, diisopropanolamine, triisopropanolamine, mono ethanol amine, diethanolamine, triethanolamine, ammonium hydroxide, sodium aluminate, potassium aluminate, calcium oxide, magnesium oxide, cesium oxide, sodium metasilicate, monosodium phosphate, disodium phosphate, trisodium phosphate, sodium tripolyphosphate, sodium sulfate, sodium borate, sodium carbonate, sodium hydrogen carbonate, sodium sesquicarbonate, sodium orthosilicate, sodium sesquisilicate, sodium polysilicates, alkaline sodium silicate, neutral sodium silicate, and combinations thereof; a surfactant, wherein the surfactant is chosen from at least one of the following: anionic detergent, cationic detergent, phosphate ester detergent, non-ionic detergent, ether sulfate detergent, amphoteric detergent, sodium soap of a fatty acid, sodium soap of a fatty acid ester, potassium soap of a fatty acid, potassium soap of a fatty acid ester, lard, tall oil, coconut fatty acid, stearic acid, oleic acid, palmitic acid, and combinations thereof; a hydrotrope, the hydrotrope being chosen from at least one of the following: sodium xylene sulfonate, sodium toluenesulfonate, surfactant-hydrotropes, urea, and combinations thereof; a water conditioner, the water conditioner being chosen from at least one of the following: ethylenediaminetetraacetic acid and salts thereof, nitrilotriacetic acid and salts thereof, sodium citrate, sodium gluconate, sodium glucoheptonate, polymaleic acid, polyacrylate, and combinations thereof; and an organic acid, the organic acid being chosen from at least one of the following: monochloro acetic acid (MCAA), carbonic acid, formic acid, acetic acid, acrylic acid, glycolic acid, lactic acid, propionic acid, maleic acid, malic acid, gluconic acid, glucaric acid, mucic acid, heptanoic acid, hexanoic acid, and combinations thereof.

Thus, the cleaning composition can be applied before, during, and after use of the equipment. The type of equipment and the industry for which it is used determine how, when, and how much of the cleaning composition is applied to the equipment.

Embodiments of the cleaning composition can include one or more of the following: surfactants, builders, hydrotropes, alkali compounds (hereinafter "alkali"), processing aids, organic acids, and water conditioners, in any combination. For example, the cleaning compositions can include one or more processing aids in combination with any one or more of the following: an alkali, a builder, a hydrotrope, and/or a surfactant. Alternatively, the cleaning compositions can include an alkali and an organic acid in combination with any one or more of the following: a processing aid and/or a surfactant. By way of further example, the cleaning compositions can include a builder and an organic acid in combination with any one or more of the following: a processing aid and/or a surfactant. Exemplary cleaning compositions are shown below and in Tables 1 and 2.

The cleaning compositions can be prepared as a powder and diluted with a solvent (e.g., water) to achieve various concentrations of active ingredients (e.g., surfactant, builder, hydrotrope, water conditioner, alkali, and/or processing aid). In addition, the cleaning composition can be applied as a solution, a foam, or an emulsion.

The cleaning composition can include one or more builders/alkalis such as, for example, sodium metasilicate, monosodium phosphate, disodium phosphate, trisodium phosphate, sodium tripolyphosphate, sodium sulfate, sodium borate, sodium carbonate, sodium hydrogen carbonate, sodium sesquicarbonate, sodium orthosilicate, sodium sesquisilicate, sodium polysilicates, alkaline sodium silicate, neutral sodium silicate (without free or excess sodium hydroxide), sodium hydroxide, potassium hydroxide, calcium hydroxide, magnesium hydroxide, cesium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, potassium aluminate, calcium oxide, and magnesium oxide. Preferred alkalis include sodium hydroxide, potassium hydroxide, magnesium hydroxide, calcium hydroxide, and sodium aluminate. One skilled in the art would understand that the terms "builder" and "alkali" are often used interchangeably. Preferred builders include sodium metasilicate, potassium silicates, sodium phosphate, sodium carbonate, and potassium carbonate.

The cleaning composition can include one or more water conditioners. In general, the water conditioners can include chelating, sequestering, and/or crystal modifier water conditioners. In particular, the water conditioners can include compounds such as, for example, ethylenediaminetetraacetic acid and salts thereof, nitrilotriacetic acid and salts thereof, sodium citrate, sodium gluconate, sodium glucoheptonate, polymaleic acid, and polyacrylate. Preferred water conditioners include crystal modifiers, ethylenediaminetetraacetic acid and salts, nitrilotriacetic acid, and polymaleic acid salts.

The cleaning composition can include one or more surfactants such as, for example, anionic detergents, cationic detergents, phosphate ester detergents, non-ionic detergents, ether sulfate detergents, amphoteric detergents, sodium soaps of fatty acids, sodium soaps of fatty acid esters, potassium soaps of fatty acids, potassium soaps of fatty acid esters, lard, tall oil, coconut fatty acid, stearic acid, oleic acid, and palmitic acid. Preferred surfactants include phosphate ester detergents, non-ionic detergents, and soaps.

The cleaning composition can include one or more hydrotropic compounds (hydrotropes) such as, for example, sodium xylene sulfonate, sodium toluenesulfonate, surfactant-hydrotropes, and urea. Preferred hydrotropes include sodium xylene sulfonate and urea.

The cleaning composition can include one or more organic acids. The term "organic acids" also includes substituted organic acids, carboxylic acids, substituted carboxylic acids (including chlorinated, brominates, fluorinated, etc. substitutions of the carboxylic acids), acid anhydrides, and modified organic acids, all of which only have a carbon chain in the range of $C_{1-7}$. "Modified organic acids" include, for example, those modified by hydrolysis, rearrangement, isomerization, halogenation, oxidation, esterification, sulfonation, acetylation, hydrogenation, reduction, and/or neutralization. The term "organic acid" specifically does not include inorganic or mineral acids, such as sulphuric, nitric, phosphoric, hydrochloric acids, etc. For example, the organic acid can be, but is not limited to, mono-chloro acetic acid (MCAA), carbonic acid, formic acid, acetic acid, acrylic acid, glycolic acid, lactic acid, propionic acid, maleic acid, malic acid, gluconic acid, glucaric acid, mucic acid, heptanoic acid, and/or hexanoic acid. The organic acid can be present in an amount of about 0.2% to about 60% by weight of the composition.

The cleaning composition can include one or more processing aids such as, for example, carboxymethylcellulose sodium alginate, saccharides (including monosaccharides, oligosaccharides, and polysaccharides such as, e.g., disaccharides, trisaccharides, tetrasaccharides, pentasaccharides, hexassaccharides, heptasaccharides, octasaccharides, or nonasaccharides), sugar alcohols (e.g., sorbitol, manitol, erythritol, xylitol, lactitol, or 1,6-dichloro-1,6-dideoxy-BETA-D-fructofuranosyl-4-chloro-4-deoxy-alpha-D-galactopyranoside (also known as Splenda®)), esters of saccharides (e.g., sorbate, lactate, etc.), amino-saccharides, gums, guar gums, xanthan, polyacrylates (e.g., polyacrylate, polymethacrylate, polyethylacrylate, polypropylacrylate, polybutylacrylate, polypentylacrylate, polyhexylacrylate, polyheptylacrylate, polyoctylacrylate, polynonyl acrylate, polydecyl acrylate, polyundecyl acrylate, or polydodecyl acrylate, or any other suitable substituted polyacrylate), vinylacrylates, polyvinylacrylates, vinyl acetates, polyvinylacetates, polyacrylamides, polylactates, polyglycolates, polyacetates, formates, acetates, glycolates, lactates, gluconates, glucarates, glucoheptonates, mixed polyacrylate-polymalate, or polyacrylic acid partial sodium salt, or combinations thereof. Preferred processing aids include guar gums, starches, polyacrylates, or saccharides. Any processing aid can be used that has been processed under the following reactions: hydrolysis, rearrangement, glycosylation, enzymatic modification of any mono-nano saccharide, fermentation, maillard reaction, isomerization, halogenation, oxidation, esterification, sulfonation, acetylation, hydrogenation, reduction, and/or neutralization.

In addition, dyes, pigments, or other coloring agents can be added to the cleaning composition.

All components of the disclosed cleaning compositions that are in the form of a salt can be alternately selected as the sodium salt thereof, cesium salt thereof, potassium salt thereof, calcium salt thereof, magnesium salt thereof, zinc salt thereof, aluminum salt thereof, barium salt thereof, beryllium salt thereof, ammonium salt thereof, or lithium salt thereof, as known to those skilled in the art. By way of example but not purposes of limitation, although most the builders above are referenced with respect to the sodium salt (e.g., sodium carbonate), other cationic species are also appropriate (e.g., cesium carbonate). As another example but not for purposes of limitation, although oxide alkalis above are referenced with respect to the calcium and magnesium salts (e.g., calcium oxide and magnesium oxide), other cationic species are also appropriate (e.g., cesium oxide).

An embodiment of the cleaning composition can include about 0.2 to about 25 weight percent of a surfactant and one or more of the following components: about 0.1 to about 99 weight percent of a builder, about 5 to about 95 weight percent of a hydrotrope, about 2 to about 60 weight percent of a water conditioner, about 0.1 to about 35 weight percent of an alkali, and about 2 to about 85 weight percent of a processing aid.

A second embodiment of the cleaning composition can include about 0.2 to about 25 weight percent of a surfactant, about 5 to about 99 weight percent of a builder, and one or more of the following components: about 5 to about 95 weight percent of a hydrotrope, about 2 to about 60 weight percent of a water conditioner, about 0.1 to about 35 weight percent of an alkali, and about 2 to about 85 weight percent of a processing aid.

A third embodiment of the cleaning composition can include about 0.2 to about 25 weight percent of a surfactant, about 0.5 to about 99 weight percent of a alkali, and one or more of the following components: about 5 to about 99 weight percent of a hydrotrope, about 2 to about 85 weight percent of a water conditioner, and about 2 to about 95 weight percent of a processing aid.

A fourth embodiment of the cleaning composition can include about 0.2 to about 20 weight percent of a surfactant, about 5 to about 99 weight percent of a hydrotrope, and one or more of the following components: about 2 to about 49 weight percent of a water conditioner and about 2 to about 85 weight percent of a processing aid.

A fifth embodiment of the cleaning composition can include about 0.2 to about 20 weight percent of a surfactant, about 35 to about 49 weight percent of a water conditioner, and about 1 to about 95 weight percent of a processing aid.

A sixth embodiment of the cleaning composition can include about 20 to about 95 weight percent of a builder, about 0.2 to about 20 weight percent of a surfactant, about 5 to about 80 weight percent of a hydrotrope, about 1 to about 30 weight percent of a water conditioner, about 0.1 to about 20 weight percent of an alkali, and about 0.5 to about 95 weight percent of a processing aid.

A seventh embodiment of the cleaning composition can include about 20 to about 50 weight percent of a builder, about 0.2 to about 20 weight percent of a surfactant, about 20 to about 40 weight percent of a hydrotrope, about 1 to about 15 weight percent of a water conditioner, about 0.1 to about 15 weight percent of an alkali, and about 0.5 to about 80 weight percent of a processing aid.

As indicated above, embodiments of the cleaning composition can be diluted with a solvent such as water to prepare a cleaning composition solution having specific concentrations of the active agents. Thereafter, the cleaning composition solution can be applied to the equipment in need of treatment.

An embodiment of the cleaning composition that can be used to prevent concrete and/or cement from hardening or setting can include about 10 to about 55 weight percent of a builder, about 0.1 to about 20 weight percent of a surfactant, about 1 to about 30 weight percent of a water conditioner, or about 0.1 to about 20 weight percent of an organic acid, or about 0.2 to about 35 weight percent of a processing aid.

An embodiment of the cleaning composition that can be used to prevent concrete and/or cement from hardening or setting can include about 1 to about 35 weight percent of a builder, about 0.1 to about 10 weight percent of a surfactant, about 0.1 to about 10 weight percent of a water conditioner, or about 0.1 to about 20 weight percent of an organic acid, or about 0.2 to about 35 weight percent of a processing aid.

An embodiment of the cleaning composition that can be used to prevent concrete and/or cement from hardening or setting can include about 25 to about 85 weight percent of a builder, about 0.1 to about 10 weight percent of a surfactant, about 0.1 to about 10 weight percent of a water conditioner, or about 0.1 to about 20 weight percent of an organic acid, or about 0.2 to about 35 weight percent of a processing aid.

An embodiment of the basic, cleaning composition that can be used for cleaning concrete or cement industry equipment can include about 0.1 to about 25 weight percent of a builder, about 0.1 to about 5 weight percent of a surfactant, about 0.1 to about 15 weight percent of a water conditioner, or about 0.1 to about 15 weight percent of a processing aid.

An embodiment of the basic, cleaning composition that can be used for cleaning concrete or cement industry equipment can include about 0.1 to about 25 weight percent of a builder, about 0.1 to about 5 weight percent of a surfactant, about 0.1 to about 15 weight percent of a organic acid.

An embodiment of the basic, cleaning composition that can be used for cleaning concrete or cement industry equipment can include about 10 to about 75 weight percent of a builder, about 0.1 to about 15 weight percent of a surfactant, about 0.1 to about 15 weight percent of a water conditioner, or about 2 to about 25 percent of a organic acid, or about 0.1 to about 15 weight percent of a processing aid.

Additional embodiments are shown in Tables 1 and 2. Table 1 lists some possible embodiments of the chemical compositions as a powder. Table 2 lists exemplary embodiments of the chemical composition diluted in water. One or more of the organic acids discussed above could also be included in any of the embodiments disclosed in Tables 1 and 2.

TABLE 1

| Cleaning Composition (CC) | Builder | Surfactant | Alkali | Hydrotrope | Water Conditioner | Processing Aid |
|---|---|---|---|---|---|---|
| CC1 | 85-99 | 0.2-25 | — | — | — | — |
| CC2 | 75-95 | 0.2-20 | 0.1-25 | — | — | — |
| CC3 | 35-90 | 0.2-20 | — | 5-95 | — | — |
| CC4 | 35-90 | 0.2-20 | — | — | 2-60 | — |
| CC5 | 35-90 | 0.2-20 | — | — | — | 2-85 |
| CC6 | 35-90 | 0.2-20 | 0.1-35 | 5-95 | — | — |
| CC7 | 55-90 | 0.2-15 | 1.35 | — | 2-19 | — |
| CC8 | 55-9 | 0.2-15 | 1-35 | — | — | 2-85 |
| CC9 | 35-90 | 0.2-20 | 0.1-35 | 5-95 | 2-40 | — |
| CC10 | 35-90 | 0.2-20 | 0.1-35 | — | 2-40 | 2-85 |
| CC11 | — | 0.2-15 | 85-99 | — | — | — |
| CC12 | — | 0.2-20 | 0.5-95 | 5-99 | — | — |
| CC13 | — | 0.2-20 | 0.5-95 | — | 5-85 | — |
| CC15 | — | 0.2-20 | 0.5-95 | — | — | 2-95 |
| CC16 | — | 0.2-20 | 0.5-95 | 35-95 | — | 2-90 |
| CC17 | — | 0.2-20 | 0.5-95 | — | 2-25 | 2-90 |
| CC18 | — | 0.2-20 | 0.5-95 | 35-90 | 2-25 | 2-90 |
| CC19 | — | 0.2-15 | — | 85-99 | — | — |
| CC20 | — | 0.2-20 | — | 35-97 | 2-49 | — |
| CC21 | — | 0.2-20 | — | 35-97 | — | 2-85 |
| CC22 | — | 0.2-20 | — | 35-97 | 2-25 | 2-85 |
| CC23 | — | 0.2-20 | 35-97 | — | 2-25 | 2-60 |
| CC24 | — | 0.2-15 | — | — | 85-99 | 0 |
| CC25 | — | 0.2-20 | — | — | 35-99 | 1-95 |
| CC26 | 20-46 | 0.2-20 | 0.1-16 | 26-40 | 1-12 | 1-95 |
| CC27 | 40-95 | 0.2-20 | 0.1-20 | 5-80 | 1-28 | 0.5-80 |

TABLE 2

| Cleaning Composition (CC) | Water | Builder | Surfactant | Alkali | Hydrotrope | Water Conditioner | Processing Aid |
|---|---|---|---|---|---|---|---|
| CC1 | 20-90 | 2-55 | 0.2-15 | — | — | — | — |
| CC2 | 20-90 | 2-55 | 0.2-15 | 0.1-30 | — | — | — |
| CC3 | 20-90 | 2-55 | 0.2-15 | — | 1-48 | — | — |
| CC4 | 20-90 | 2-55 | 0.2-15 | — | — | 1-18 | — |
| CC5 | 20-90 | 2-55 | 0.2-15 | — | — | — | 1-70 |
| CC6 | 20-90 | 2-55 | 0.2-20 | 0.1-30 | 1-48 | — | — |
| CC7 | 20-90 | 2-55 | 0.2-20 | 0.1-30 | — | 1-18 | — |
| CC8 | 20-90 | 2-55 | 0.2-20 | 0.1-30 | — | — | 1-70 |
| CC9 | 20-90 | 2-55 | 0.2-20 | 0.1-30 | 1-48 | 1-18 | — |
| CC10 | 20-90 | 2-55 | 0.2-20 | 0.1-30 | — | 1-18 | 1-70 |
| CC11 | 20-90 | — | 0.2-15 | 1-52 | — | — | — |
| CC12 | 20-90 | — | 0.2-15 | 0.1-30 | 1-48 | — | — |

TABLE 2-continued

| Cleaning Composition (CC) | Water | Builder | Surfactant | Alkali | Hydrotrope | Water Conditioner | Processing Aid |
|---|---|---|---|---|---|---|---|
| CC13 | 20-90 | — | 0.2-15 | 0.1-30 | — | 1-48 | — |
| CC14 | 20-90 | — | 0.2-15 | 0.1-30 | — | — | 1-95 |
| CC15 | 20-90 | — | 0.2-20 | 0.1-30 | 1-48 | 1-18 | — |
| CC16 | 20-90 | — | 0.2-20 | 0.1-30 | 1-48 | — | 1-20 |
| CC17 | 20-90 | — | 0.2-20 | 0.1-30 | — | 1-18 | 1-90 |
| CC18 | 20-90 | — | 0.2-20 | 0.1-30 | 1-48 | 1-18 | 1-70 |
| CC19 | 20-90 | — | 0.2-15 | — | 1-48 | — | — |
| CC20 | 20-90 | — | 0.2-15 | — | 1-48 | 1-18 | — |
| CC21 | 20-90 | — | 0.2-15 | — | 1-48 | — | 1-80 |
| CC22 | 20-90 | — | 0.2-20 | — | 1-48 | 1-18 | 1-70 |
| CC23 | 20-90 | — | 0.2-15 | — | — | 1-46 | — |
| CC24 | 20-90 | — | 0.2-15 | — | — | 1-46 | 1-90 |
| CC25 | 10-70 | 2-29 | 0.2-15 | 0.1-30 | 1-44 | 1-18 | 1-41 |
| CC26 | 16-65 | 1-18 | 0.2-12 | 0.1-12 | 0.5-28 | 0.1-8 | 0.5-60 |

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range.

It should be noted that although the recited components of the composition render the composition a single-phase composition, other components could be added to the disclosed composition that may render the subsequent, altered composition an emulsion or a multi-phase composition. Such emulsions or multi-phase compositions are considered to be within the scope of the present disclosure due to the presence of the components recited above. For example, a cleaning composition including one or more of an alkali, and organic acid, a processing aid, and a surfactant, that also includes a small amount of an oil (for example, about 1% vegetable oil), the composition may technically be considered an "emulsion." Nevertheless such a composition falls within the scope of the present disclosure and its accompanying claims.

It should be emphasized that the above-described embodiments of the present disclosure, particularly, any "preferred" embodiments, are merely possible examples of implementations, merely set forth for a clear understanding of the principles of the disclosure. Many variations and modifications can be made to the above-described embodiment(s) without departing substantially from the principles of the disclosure. All such modifications and variations are intended to be included herein within the scope of this disclosure and protected by the following claims.

I claim:

1. A method of treating equipment of oil-based contamination, comprising the step of applying a basic, aqueous cleaning composition to equipment, thereby removing oil-based contamination from the equipment, wherein the equipment includes that from at least one of the following industries: asphalt industry, bituminous, and oil field and consists essentially of:

about 0.1% to about 99% by weight of an alkali, wherein the alkali is chosen from at least one of the following: sodium hydroxide, potassium hydroxide, calcium hydroxide, magnesium hydroxide, cesium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, potassium aluminate, calcium oxide, magnesium oxide, cesium oxide, sodium metasilicate monosodium phosphate, disodium phosphate, trisodium phosphate, sodium tripolyphosphate, sodium sulfate, sodium borate, sodium carbonate, sodium hydrogen carbonate, sodium sesquicarbonate, sodium orthosilicate, sodium sesquisilicate, sodium polysilicates, alkaline sodium silicate, neutral sodium silicate, and combinations thereof and about 0.2% to about 60% by weight of an organic acid, the organic acid being chosen from at least one of the following: mono-chloral acetic acid (MCAA), carbonic acid, formic acid, acetic acid, alycolic acid, lactic acid, propionic acid, maleic acid, malic acid, gluconic acid, glucaric acid, mucic acid, heptanoic acid, hexanoic acid, and combinations thereof.

2. A method of treating equipment of oil-based contamination, comprising the step of applying a basic, aqueous cleaning composition to equipment, thereby removing oil-based contamination from the equipment, wherein the equipment includes that from at least one of the following industries: asphalt industry, bituminous, and oil field, and comprises:

about 0.1% to about 99% by weight of an alkali, wherein the alkali is chosen from at least one of the following: sodium hydroxide, potassium hydroxide, calcium hydroxide, magnesium hydroxide, cesium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, potassium aluminate, calcium oxide, magnesium oxide, cesium oxide, sodium metasilicate, monosodium phosphate, disodium phosphate, trisodium phosphate, sodium tripolyphosphate, sodium sulfate, sodium borate, sodium carbonate, sodium hydrogen carbonate, sodium sesquicarbonate, sodium orthosilicate, sodium sesquisilicate, sodium polysilicates, alkaline sodium silicate, neutral sodium silicate, and combinations thereof;

about 0.1% to about 30% by weight of a surfactant, wherein the surfactant is chosen from at least one of the following: anionic detergent, cationic detergent, phosphate ester detergent, non-ionic detergent, ether sulfate detergent, amphoteric detergent, sodium soap of a fatty acid, sodium soap of a fatty acid ester, potassium soap of a fatty acid, potassium soap of a fatty acid ester, lard, tall oil, coconut fatty acid, stearic acid, oleic acid, palmitic acid, and combinations thereof; and about 0.2% to about 60% by weight of an organic acid, the organic acid being chosen from at least one of the following: mono-chloro acetic acid (MCAA), carbonic acid, formic acid, acetic acid, alycolic acid, lactic acid, propionic acid, maleic acid, malic acid, gluconic acid, glucaric acid, mucic acid, heptanoic acid, hexanoic acid, and combinations thereof.

3. The method of claim 2, wherein the composition further comprises about 0.2% to about 95% by weight of a hydrotrope, the hydrotrope being chosen from at least one of the following: sodium xylene sulfonate, sodium toluenesulfonate, surfactant-hydrotropes, urea, and combinations thereof.

4. The method of claim 3, wherein the composition further comprises about 0.1% to about 95% by weight of a water conditioner, the water conditioner being chosen from at least one of the following: ethylenediaminetetraacetic acid and salts thereof, nitrilotriacetic acid and salts thereof, sodium citrate, sodium gluconate, sodium glucoheptonate, polymaleic acid, polyacrylate, and combinations thereof.

5. The method of claim 2, wherein the composition further comprises about 0.2% to about 85% of a processing aid, the processing aid being chosen from at least one of the following: carboxymethylcellulose sodium alginate, monosaccharide, oligosaccharide, polysaccharide, disaccharide, trisaccharide, tetrasaccharide, pentasaccharide, hexassaccharide, heptasaccharide, octasaccharide, nonasaccharide, sugar alcohol, 1 ,6-dichloro-1, 6-dideoxy-BETA-D-fructofuranosyl-4-chloro-4-deoxy-alpha-D-galactopyranoside, sorbitol, manitol, erythritol, xylitol, lactitol, esters of saccharides, sorbate, lactate, amino-saccharide, gum, guar gum, xanthan, polyacrylate, polymethacrylate, polyethylacrylate, polypropylacrylate, polybutylacrylate, polypentylacrylate, polyhexylacrylate, polyheptylacrylate, polyoctylacrylate, polynonyl acrylate, polydecyl acrylate, polyundecyl acrylate, polydodecyl acrylate, vinylacrylates, polyvinylacrylates, vinyl acetates, polyvinylacetates, polyacrylic ides, polylactates, polyglycolates, polyacetates, formates, acetates, glycolates, lactates, gluconates, glucarates, glucoheptonates, mixed polyacrylate-polymalate, polyacrylic acid partial sodium salt, and combinations thereof.

6. A method of treating equipment of oil-based contamination, comprising the step of applying a basic, aqueous cleaning composition to equipment, thereby removing oil-based contamination from the equipment, wherein the equipment includes that from at least one of the following industries: asphalt industry, bituminous, and oil field and consists essentially of an organic acid, the organic acid being chosen from at least one of the following: mono-chloro acetic acid (MCAA), carbonic acid, formic acid, acetic acid, glycolic acid, lactic acid, propionic acid, maleic acid, malic acid, gluconic acid, glucaric acid, mucic acid, heptanoic acid, hexanoic acid, and combinations thereof.

7. A method of treating equipment of oil-based contamination, comprising the step of applying a basic, aqueous cleaning composition to equipment, thereby removing oil-based contamination from the equipment, wherein the equipment includes that from at least one of the following industries: asphalt industry, bituminous, and oil field, and wherein the cleaning composition consists essentially of a processing aid chosen from at least one of the following: monosaccharide, oligosaccharide, polysaccharide, disaccharide, trisaccharide, tetrasaccharide, pentasaccharide, hexassaccharide, heptasaccharide, octasaccharide, nonasaccharide, sugar alcohol, 1,6-dichloro-1,6-dideoxy-BETA-D-fructofuranosyl-4-chloro-4-deoxy-alpha-D-galactopyranoside, sorbitol, manitol, erythritol, xylitol, lactitol, esters of saccharides, lactate, amino-saccharide, vinyl acetates, polyvinylacetates, polylactates, polyglycolates, polyacetates, formates, glycolates, lactates, gluconates, glucarates, glucoheptonates, mixed polyacrylate-polymalate, and combinations thereof.

8. A method of treating equipment of oil-based contamination, thereby removing oil-based contamination from the equipment, comprising the step of applying a basic, aqueous cleaning composition to equipment, wherein the equipment includes that from at least one of the following industries: asphalt industry, bituminous, and oil field, and comprises:

about 0.2% to about 85% by weight of a processing aid, the processing aid being chosen from at least one of the following: monosaccharide, oligosaccharide, polysaccharide, disaccharide, trisaccharide, tetrasaccharide, pentasaccharide, hexassaccharide, heptasaccharide, octasaccharide, nonasaccharide, sugar alcohol, 1 ,6-dichloro-1, 6-dideoxy-BETA-D-fructofuranosyl-4-chloro-4-deoxy-alpha-D-galactopyranoside, sorbitol, manitol, erythritol, xylitol, lactitol, esters of saccharides lactate, amino-saccharide, vinyl acetates, polyvinylacetates, polylactates, polyglycolates, polyacetates, formates, glycolates, lactates, gluconates, glucarates, glucoheptonates, mixed polyacrylate-polymalate, and combinations thereof; and about 0.1% to about 99% by weight of an alkali, wherein the alkali is chosen from at least one of the following: sodium hydroxide, potassium hydroxide, calcium hydroxide, magnesium hydroxide, cesium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, potassium aluminate, calcium oxide, magnesium oxide, cesium oxide, sodium tripolyphosphate, sodium sulfate, sodium borate, sodium carbonate, sodium hydrogen carbonate, sodium sesquicarbonate, sodium orthosilicate, sodium sesquisilicate, sodium polysilicates, alkaline sodium silicate, neutral sodium silicate and combinations thereof.

9. The method of claim 8, wherein the composition further comprises about 0.2% to about 95% by weight of a hydrotrope, the hydrotrope being chosen from at least one of the following: sodium xylene sulfonate, sodium toluenesulfonate, surfactant-hydrotropes, urea, and combinations thereof.

10. The method of claim 8, wherein the composition further comprises about 0.1% to about 95% by weight of a water conditioner, the water conditioner being chosen from at least one of the following: ethylenediaminetetraacetic acid and salts thereof, nitrilotriacetic acid and salts thereof, sodium citrate, sodium gluconate, sodium glucoheptonate, polymaleic acid, polyacrylate, and combinations thereof.

11. The method of claim 8, wherein the composition further comprises about 0.2% to about 60% by weight of an organic acid, the organic acid being chosen from at least one of the following: mono-chloro acetic acid (MCAA), carbonic acid, formic acid, acetic acid, acrylic acid, glycolic acid, lactic acid, propionic acid, maleic acid, malic acid, gluconic acid, glucaric acid, mucic acid, heptanoic acid, hexanoic acid and combinations thereof.

12. A method of treating equipment of oil-based contamination thereby removing oil-based contamination from the equipment, comprising the step of applying a basic, aqueous cleaning composition to equipment, wherein the equipment includes that from at least one of the following industries: asphalt industry, bituminous, and oil field and comprises:

about 0.2% to about 60% of an organic acid, the organic acid being chosen from at least one of the following: mono-chloro acetic acid (MCAA), carbonic acid, formic acid, acetic acid, glycolic acid, lactic acid, propionic acid, maleic acid, malic acid, gluconic acid, glucaric acid, mucic acid, heptanoic acid, hexanoic acid, and combinations thereof; and about 0.1% to about 95% by weight of a water conditioner, the water conditioner being chosen from at least one of the following: ethylenediaminetetraacetic acid and salts thereof, nitrilotriacetic acid and salts thereof, sodium citrate, sodium gluconate, sodium glucoheptonate, polymaleic acid, polyacrylate, and combinations thereof.

13. The method of claim 12, wherein the composition further comprises about 0.1% to about 99% by weight builder, the builder being chosen from at least one of the following: sodium metasilicate, monosodium phosphate, disodium phosphate, trisodium phosphate, sodium tripolyphosphate, sodium sulfate, sodium borate, sodium carbonate, sodium hydrogen carbonate, sodium sesquicarbonate, sodium orthosilicate, sodium sesquisilicate, sodium polysilicates, alkaline sodium silicate, neutral sodium silicate, sodium hydroxide, potassium hydroxide, calcium hydroxide, magnesium hydroxide, cesium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, potassium aluminate, calcium oxide, magnesium oxide, cesium oxide, and combinations thereof.

14. The method of claim 12, wherein the composition further comprises about 0.2% to about 95% by weight of a hydrotrope, the hydrotrope being chosen from at least one of the following: sodium xylene sulfonate, sodium toluenesulfonate, surfactant-hydrotropes, urea, and combinations thereof.

15. The method of claim 14, wherein the composition further comprises about 0.1% to about 30% by weight of a surfactant, wherein the surfactant is chosen from at least one of the following: anionic detergent, cationic detergent, phosphate ester detergent, non-ionic detergent, ether sulfate detergent, amphoteric detergent, sodium soap of a fatty acid, sodium soap of a fatty acid ester, potassium soap of a fatty acid, potassium soap of a fatty acid ester, lard, tall oil, coconut fatty acid, stearic acid, oleic acid, palmitic acid, and combinations thereof.

16. The method of claim 14, wherein the composition further comprises about 0.2% to about 85% of a processing aid, the processing aid being chosen from at least one of the following: carboxymethylcellulose sodium alginate, monosaccharide, oligosaccharide, polysaccharide, disaccharide, trisaccharide, tetrasaccharide, pentasaccharide, hexassaccharide, heptasaccharide, octasaccharide, nonasaccharide, sugar alcohol, 1,6-dichloro-1,6-dideoxy-BETA-D-fructofuranosyl-4-chloro-4-deoxy-alpha-D-galactopyranoside, sorbitol, manitol, erythritol, xylitol, lactitol, esters of saccharides, sorbate, lactate, amino-saccharide, gum, guar gum, xanthan, polyacrylate, polymethacrylate, polyethylacrylate, polypropylacrylate, polybutylacrylate, polypentylacrylate, polyhexylacrylate, polyheptylacrylate, polyoctylacrylate, polynonyl acrylate, polydecyl acrylate, polyundecyl acrylate, polydodecyl acrylate, vinylacrylates, polyvinylacrylates, vinyl acetates, polyvinylacetates, polyacrylamides, polylactates, polyglycolates, polyacetates, formates, acetates, glycolates, lactates, gluconates, glucarates, glucoheptonates, mixed polyacrylate-polymalate, polyacrylic acid partial sodium salt, and combinations thereof.

17. A method of treating equipment of oil-based contamination, comprising the step of applying a basic, aqueous cleaning composition to equipment, thereby removing oil-based contamination from the equipment, wherein the equipment includes that from at least one of the following industries: asphalt industry, bituminous, and oil field, and consists essentially of:

a builder chosen from at least one of the following: sodium metasilicate, monosodium phosphate, disodium phosphate, trisodium phosphate, sodium tripolyphosphate, sodium sulfate, sodium borate, sodium carbonate, sodium hydrogen carbonate, sodium sesquicarbonate, sodium orthosilicate, sodium sesquisilicate, sodium polysilicates, alkaline sodium silicate, neutral sodium silicate, sodium hydroxide, potassium hydroxide, calcium hydroxide, magnesium hydroxide, cesium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, potassium aluminate, calcium oxide, magnesium oxide, cesium oxide, and combinations thereof; and about 0.2% to about 60% of an organic acid, the organic acid being chosen from at least one of the following: mono-chloro acetic acid (MCAA), carbonic acid, formic acid, acetic acid, alycolic acid, lactic acid, propionic acid, maleic acid, malic acid, gluconic acid, glucaric acid, mucic acid, heptanoic acid, hexanoic acid, and combinations thereof.

18. A method of treating equipment of oil-based contamination, comprising the step of applying a basic, aqueous cleaning composition to equipment, thereby removing oil-based contamination from the equipment, wherein the equipment includes that from at least one of the following industries: asphalt industry, bituminous, and oil field, and comprises:

about 0.1% to about 99% by weight builder, the builder being chosen from at least one of the following: sodium metasilicate, monosodium phosphate, disodium phosphate, trisodium phosphate, sodium tripolyphosphate, sodium sulfate, sodium borate, sodium carbonate, sodium hydrogen carbonate, sodium sesquicarbonate, sodium orthosilicate, sodium sesquisilicate, sodium polysilicates, alkaline sodium silicate, neutral sodium silicate, sodium hydroxide, potassium hydroxide, calcium hydroxide, magnesium hydroxide, cesium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, potassium aluminate, calcium oxide, magnesium oxide, cesium oxide, and combinations thereof;

about 0.1% to about 30% by weight of a surfactant, wherein the surfactant is chosen from at least one of the following: anionic detergent, cationic detergent, phosphate ester detergent, non-ionic detergent, ether sulfate detergent, amphoteric detergent, sodium soap of a fatty acid, sodium soap of a fatty acid ester, potassium soap of a fatty acid, potassium soap of a fatty acid ester, lard, tall oil, coconut fatty acid, stearic acid, oleic acid, palmitic acid, and combinations thereof; and about 0.2% to about 60% by weight of an organic acid, the organic acid being chosen from at least one of the following: mono-chloro acetic acid (MCAA), carbonic acid, formic acid, acetic acid, glycolic acid, lactic acid, propionic acid, maleic acid, malic acid, gluconic acid, glucaric acid, mucic acid, heptanoic acid, hexanoic acid, and combinations thereof.

19. The method of claim 18, wherein the composition further comprises about 0.2% to about 95% by weight of a hydrotrope, the hydrotrope being chosen from at least one of the following: sodium xylene sulfonate, sodium toluenesulfonate, surfactant-hydrotropes, urea, and combinations thereof.

20. The method of claim 18, wherein the composition further comprises about 0.1% to about 95% by weight of a water conditioner, the water conditioner being chosen from at least one of the following: ethylenediaminetetraacetic acid and salts thereof, nitrilotriacetic acid and salts thereof, sodium citrate, sodium gluconate, sodium glucoheptonate, polymaleic acid, polyacrylate, and combinations thereof.

21. A method of treating equipment of oil-based contamination, comprising the step of applying a basic, aqueous cleaning composition to equipment, thereby removing oil-based contamination from the equipment, wherein the equipment includes that from at least one of the following industries: asphalt industry, bituminous, and oil field, and comprising the step of applying a aqueous cleaning composition to equipment, wherein the equipment includes asphalt industry equipment, mining industry equipment, bituminous industry equipment, tire manufacture industry equipment, rubber parts manufacturing industry equipment and oil field industry equipment, and wherein the cleaning composition comprises:

a processing aid, the processing aid being chosen from at least one of the following: carboxymethylcellulose sodium alginate, monosaccharide, oligosaccharide, polysaccharide, disaccharide, trisaccharide, tetrasaccharide, pentasaccharide, hexassaccharide, heptasaccharide, octasaccharide, nonasaccharide, sugar alcohol, 1, 6-dichloro- 1, 6-d dideoxy-BETA-D-fructofuranosyl-4-chloro-4-deoxy-alpha-D-galactopyranoside, sorbitol, manitol, erythritol, xylitol, lactitol, esters of saccharides, sorbate, lactate, amino-saccharide, gum, guar gum, xanthan, polyacrylate, polymethacrylate, polyethylacrylate, polypropylacrylate, polybutylacrylate, polypentylacrylate, polyhexylacrylate, polyheptylacrylate, polyoctylacrylate, polynonyl acrylate, polydecyl acrylate, polyundecyl acrylate, polydodecyl acrylate, vinylacrylates, polyvinylacrylates, vinyl acetates, polyvinylacetates, polyacrylic ides, polylactates, polyglycolates, polyacetates, formates, acetates, glycolates lactates, gluconates, glucarates, glucoheptonates, mixed polyacrylate-polymalate, polyacrylic acid partial sodium salt, and combinations thereof;

the cleaning composition further comprising at least one of the following: an alkali, wherein the alkali is chosen from at least one of the following: sodium hydroxide, potassium hydroxide, calcium hydroxide, magnesium hydroxide, cesium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, potassium aluminate, calcium oxide, magnesium oxide, cesium oxide, sodium metasilicate, monosodium phosphate, disodium phosphate, trisodium phosphate, sodium tripolyphosphate, sodium sulfate, sodium borate, sodium carbonate, sodium hydrogen carbonate, sodium sesquicarbonate, sodium orthosilicate, sodium sesquisilicate, sodium polysilicates, alkaline sodium silicate, neutral sodium silicate, and combinations thereof;

a surfactant, wherein the surfactant is chosen from at least one of the following: anionic detergent, cationic detergent, phosphate ester detergent, non-ionic detergent, ether sulfate detergent, amphoteric detergent, sodium soap of a fatty acid, sodium soap of a fatty acid ester, potassium soap of a fatty acid, potassium soap of a fatty acid ester, lard, tall oil, coconut fatty acid, stearic acid, oleic acid, palmitic acid, and combinations thereof;

a hydrotrope, the hydrotrope being chosen from at least one of the following: sodium xylene sulfonate, sodium toluenesulfonate, surfactant-hydrotropes, urea, and combinations thereof;

a water conditioner, the water conditioner being chosen from at least one of the following: ethylenediaminetetraacetic acid and salts thereof, nitrilotriacetic acid and salts thereof, sodium citrate, sodium gluconate, sodium glucoheptonate, polymaleic acid, polyacrylate, and combinations thereof; and an organic acid, the organic acid being chosen from at least one of the following: mono-chloro acetic acid (MCAA), carbonic acid, formic acid, acetic acid, acrylic acid, glycolic acid, lactic acid, propionic acid, maleic acid, malic acid, gluconic acid, glucaric acid, mucic acid, heptanoic acid, hexanoic acid, and combinations thereof.

22. A method of treating equipment of oil-based contamination comprising the step of:

applying a basic, aqueous cleaning composition to equipment, thereby removing oil-based contamination from the equipment, wherein the equipment includes concrete and cement industry equipment, and consists essentially of:

a processing aid, the processing aid being chosen from at least one of the following: monosaccharide, oligosaccharide, polysaccharide, disaccharide, trisaccharide, tetrasaccharide, pentasaccharide, hexassaccharide, heptasaccharide, octasaccharide, nonasaccharide, sugar alcohol, 1,6-dichloro-1, 6-dideoxy-BETA-D-fructofuranosyl-4-chloro-4-deoxy-alpha-D-galactopyranoside, sorbitol, manitol, erythritol, xylitol, lactitol, esters of saccharides, lactate, amino-saccharide, vinyl acetates, polyvinylacetates, polylactates, polyglycolates, polyacetates, formates, glycolates, lactates, gluconates, glucarates, glucoheptonates, mixed polyacrylate-polymalate, and combinations thereof; and the cleaning composition further consisting essentially of one of the following:

an alkali, wherein the alkali is chosen from at least one of the following: sodium hydroxide, potassium hydroxide, calcium hydroxide, magnesium hydroxide, cesium hydroxide, monoethylamine, diethylamine, triethylamine, monomethylamine, dimethylamine, trimethylamine, isopropylamine, diisopropylamine, isoprapanolamine, diisopropanolamine, triisopropanolamine, monoethanol amine, diethanolamine, triethanolamine, ammonium hydroxide, sodium aluminate, potassium aluminate, calcium oxide, magnesium oxide, cesium oxide, sodium metasilicate, monosodium phosphate, disodium phosphate, trisodium phosphate, sodium tripolyphosphate, sodium sulfate, sodium borate, sodium carbonate, sodium hydrogen carbonate, sodium sesquicarbonate, sodium orthosilicate, sodium sesquisilicate, sodium polysilicates, alkaline sodium silicate, neutral sodium silicate, and combinations thereof;

a surfactant, wherein the surfactant is chosen from at least one of the following: anionic detergent, cationic detergent, phosphate ester detergent, non-ionic detergent, ether sulfate detergent, amphoteric detergent, sodium soap of a fatty acid, sodium soap of a fatty acid ester, potassium soap of a fatty acid, potassium soap of a fatty acid ester, lard, tall oil, coconut fatty acid, stearic acid, oleic acid, palmitic acid, and combinations thereof;

a hydrotrope, the hydrotrope being chosen from at least one of the following: sodium xylene sulfonate, sodium toluenesulfonate, surfactant-hydrotropes, urea, and combinations thereof;

a water conditioner, the water conditioner being chosen from at least one of the following: ethylenediaminetetraacetic acid and salts thereof, nitrilotriacetic acid and salts thereof, sodium citrate, sodium gluconate, sodium glucoheptonate, polymaleic acid, polyacrylate, and combinations thereof; and an organic acid, the organic acid being chosen from at least one of the following: mono-chloro acetic acid (MCAA), carbonic acid, formic acid, acetic acid, acrylic acid, glycolic acid, lactic acid, propionic acid, maleic acid, malic acid, gluconic acid, glucaric acid, mucic acid, heptanoic acid, hexanoic acid, and combinations thereof.

* * * * *